US006497014B2

(12) United States Patent
Neugebauer

(10) Patent No.: US 6,497,014 B2
(45) Date of Patent: Dec. 24, 2002

(54) FLUIDTIGHT ZIP FASTENER

(75) Inventor: Horst Gotthard Neugebauer, Giesen-Hasede (DE)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/885,397

(22) Filed: Jun. 20, 2001

(65) Prior Publication Data

US 2002/0017010 A1 Feb. 14, 2002

(30) Foreign Application Priority Data

Jun. 20, 2000 (DE) ..... 100 30 185

(51) Int. Cl.[7] ..... A44B 19/32

(52) U.S. Cl. ..... 24/389; 24/396; 24/427; 24/387

(58) Field of Search ..... 24/384, 389, 387, 24/388, 435, 436, 427, 396

(56) References Cited

U.S. PATENT DOCUMENTS 2,515,376 A * 7/1950 Krupp
2,800,699 A * 7/1957 Armstrong
2,841,851 A * 7/1958 Van Amburg et al.
3,764,437 A * 10/1973 Heimberger
3,864,792 A * 2/1975 Takahashi et al.
3,869,765 A * 3/1975 Fukuroi
3,924,305 A * 12/1975 Hamamura
3,959,858 A * 6/1976 Fukuroi
4,607,416 A * 8/1986 Tanikawa et al.
4,825,514 A * 5/1989 Akeno
5,253,395 A * 10/1993 Yano
6,343,408 B1 * 2/2002 Neugebauer

FOREIGN PATENT DOCUMENTS

DE 2447705 * 4/1975
DE 199 24 539 A1 11/2000
JP 6-253909 * 9/1994

* cited by examiner

*Primary Examiner*—James R. Brittain
(74) *Attorney, Agent, or Firm*—Friedrich Kueffner

(57) ABSTRACT

A fluidtight zip fastener includes a pair of fluidtight zip fastener carrying tapes each having a base tape with a soft covering layer. Sewn to each carrying tape is in an offset position a continuous coupling member row. A zip fastener slider is provided for transferring the zip fastener carrying tapes into an open and closed position. The slider has lower and upper plates and a slider wedge interconnecting the plates. A guide border is shaped in a central area of the slider wedge. For increasing the sealing action of the zip fastener in an end position of the slider, the interconnected two ends of the zip fastener carrying tapes are provided with a dimensionally more confined and consequently an overpressing-ensuring elastomer guiding the slider over its guide border shaped onto the slider wedge.

10 Claims, 3 Drawing Sheets

FLUIDTIGHT ZIP FASTENER

Figure 1:
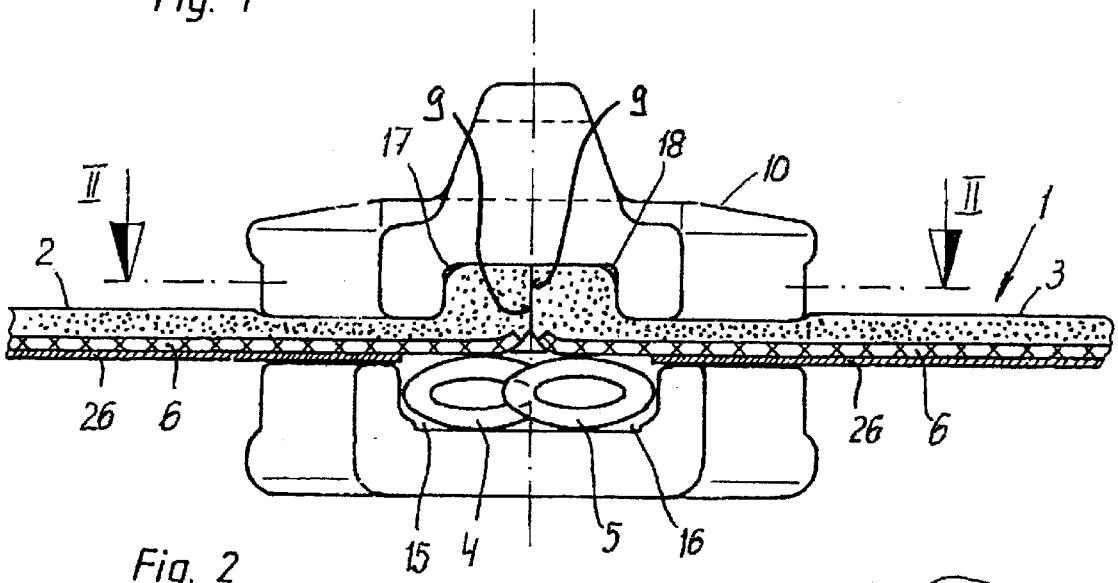

The invention relates to a fluidtight zip fastener, having a pair of fluid-tight zip fastener carrying tapes in each case comprising a base tape with a soft covering layer of elastomer, thermoplastic or the like covering at least one surface thereof and to which is in each case sewn a continuous coupling member row in a position offset in spaced manner transversely to the carrying tape longitudinal edges in such a way that the facing borders of the soft covering layers are in contact with one another along a longitudinal plane intersecting the zip fastener at a central axis thereof and at right angles to the principal plane of the zip fastener, but projecting over said longitudinal plane to such an extent that when the coupling member rows are disengaged and the coupling member rows are engaged they are bent away from that side which carries the coupling member rows and extend roughly at right angles to the principal plane of the zip fastener, the soft covering layers of the facing borders of the two zip fastener carrying tapes projecting over the base tape engage with one another in fluidtight manner under pressure action and in which the zip fastener slider transmitting the zip fastener carrying tapes into the open and closed position in the case of longitudinal displacement, apart from a lower plate, an upper plate and a slider wedge interconnecting said two plates, has a guide border shaped in the central area of the slider wedge and extending roughly parallel between the upper plate and the lower plates and which on either side of the slider wedge separates the two first chambers receiving the coupling member rows from the two second chambers receiving the facing borders of the zip fasteners carrying tapes.

Such a zip fastener forms the subject matter of the applicant's earlier-dated application 199 24 539.8-26, in which the disadvantages of conventional zip fasteners are eliminated and despite a simpler construction there is a perfect sealing action both against liquids and gases, even under pressure action, also over a longer time period. However, in the case of said earlier zip fastener it is not ensured in a completely satisfactory manner that the zip fastener slider, when transferred into the closed zip fastener state, also keeps the final coupling members of the coupling member row in a position ensuring a hermetic fluid seal. As on either side of a slider wedge, the slider keeps spaced apart the coupling members located there, special sealing measures must be taken in order to ensure an absolutely reliable seal in this end region.

On the basis of this, the problem of the invention is to so further develop a fluidtight zip fastener of the aforementioned type in such a way that in a relatively simple manner a full fluidtightness is ensured, also in the area of the zip fastener slider.

According to the invention this problem is substantially solved in that for increasing the sealing action of the zip fastener in the slider and end position, the interconnected two ends of the zip fastener carrying tapes are provided with a dimensionally more confined and consequently an overpressing-ensuring elastomer guiding the slider over its guide border shaped onto the slider wedge. Not only along the coupling member rows in the closed state, but also in the end region of the zip fastener the sought hermetic fluid seal is ensured between the upper plate and the lower plate as a result of the elastomer overpressing obtained.

In this connection is has proved very advantageous that on the side of the two interconnected ends of the zip fastener carrying tapes remote from the coupling member rows is injection method or vulcanized an oversize-possessing, approximately U-shaped, elastically flexible cam engaging on the underside of the slider upper plate. Although during the transfer of the slider into its end position such a cam offers a certain resistance due to the need of elastomer deformation, but as a result of an appropriate dimensioning of the flexible cam said resistance can be limited and consequently the actuating possibility of the slider can be controlled without disadvantageously limiting the quality of the seal.

It is particularly advantageous if in the U-shaped cam is formed at least one groove bounded by two adjacent protuberances, because this reduces the resistance action without impairing the sealing action.

According to another favourable development the groove extends over the two U-legs of the U-shaped cam and the crossbar connecting the latter and runs out in each case at the crossbar-remote leg end. In practice said leg end is the rear area of the slider in the closure/end position, i.e. the area up to which the coupling member rows are in the closed position and with their covering layers in a mutual sealing relationship.

Facing the front area of the slider in the closure position, i.e. in the area of the interconnected two ends of the zip fastener carrying tapes, is appropriately provided a transverse tie bar system absorbing transverse forces and protecting the zip fastener against damage on forcing apart or spreading. Appropriately the transverse tie bar system comprises at least one tension-proof, flexible thread, which is incorporated into the elastomer, thermoplastic, etc. below the cam crossbar linking the U-legs of the U-shaped cam. Advantageously an aramide thread is used as the tension-proof, flexible thread.

It is proved particularly advantageous with a view to a high loadability and correspondingly long zip fastener life for the transverse tie bar system to be provided alongside the coupling member rows in the end area of the zip fastener carrying tapes with in each case strong, flat reinforcing inserts and for the tension-proof, flexible threads to in each case run out over the reinforcing inserts or for them to be woven therein. Use is advantageously made of reinforcing inserts formed by a polyester woven fabric.

Further details, advantages and features of the invention can be gathered from the following description relative to the attached drawings, wherein show:

FIG. 1 A diagrammatic sectional view of a zip fastener directly upstream of the zip fastener end with the zip fastener slider transferring the two zip fastener carrying tapes into the closed, fluidtight state.

Figure 2:
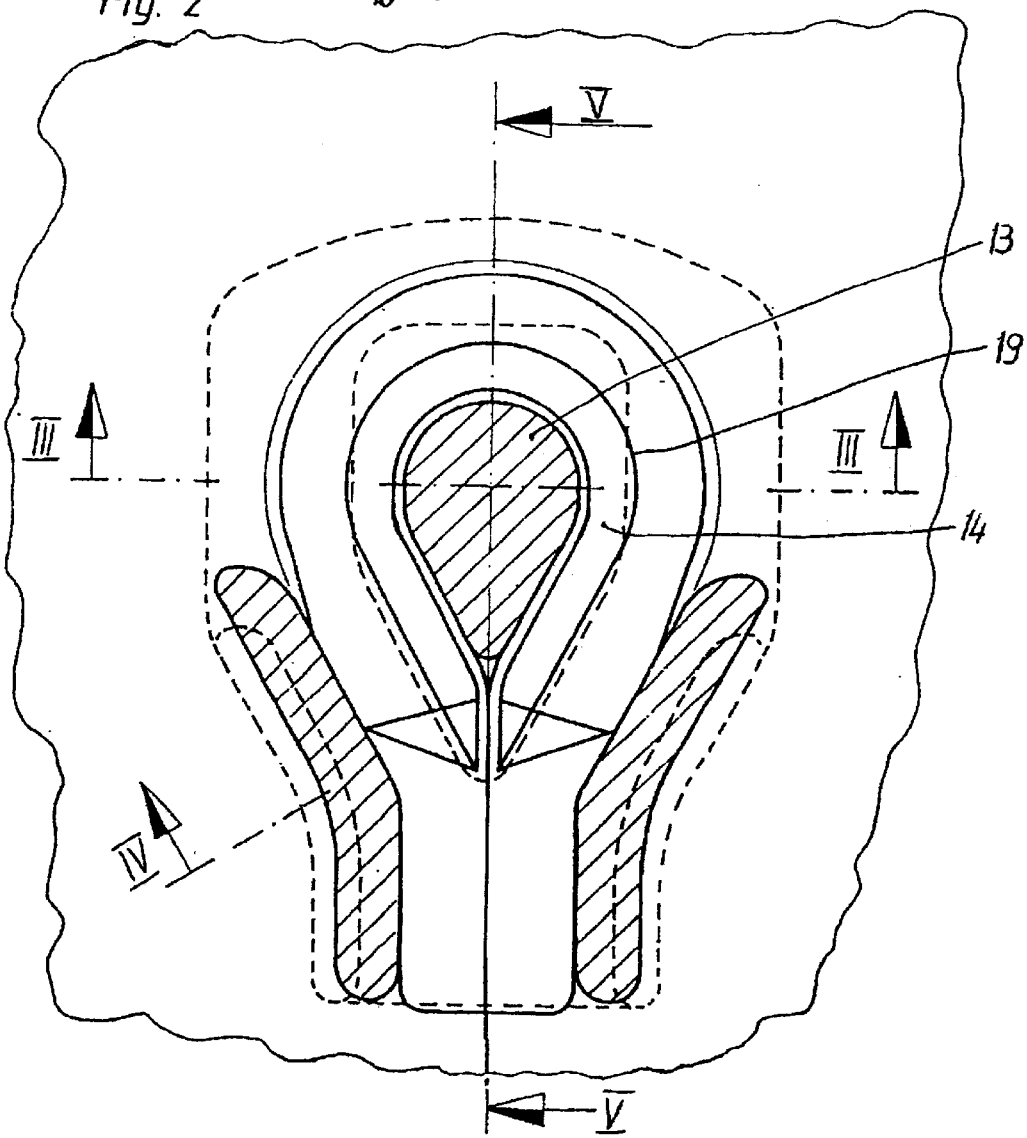

FIG. 2 A plan view of the zip fastener with slider according to FIG. 1 partly in section along line II—II of FIG. 1.

Figure 3:
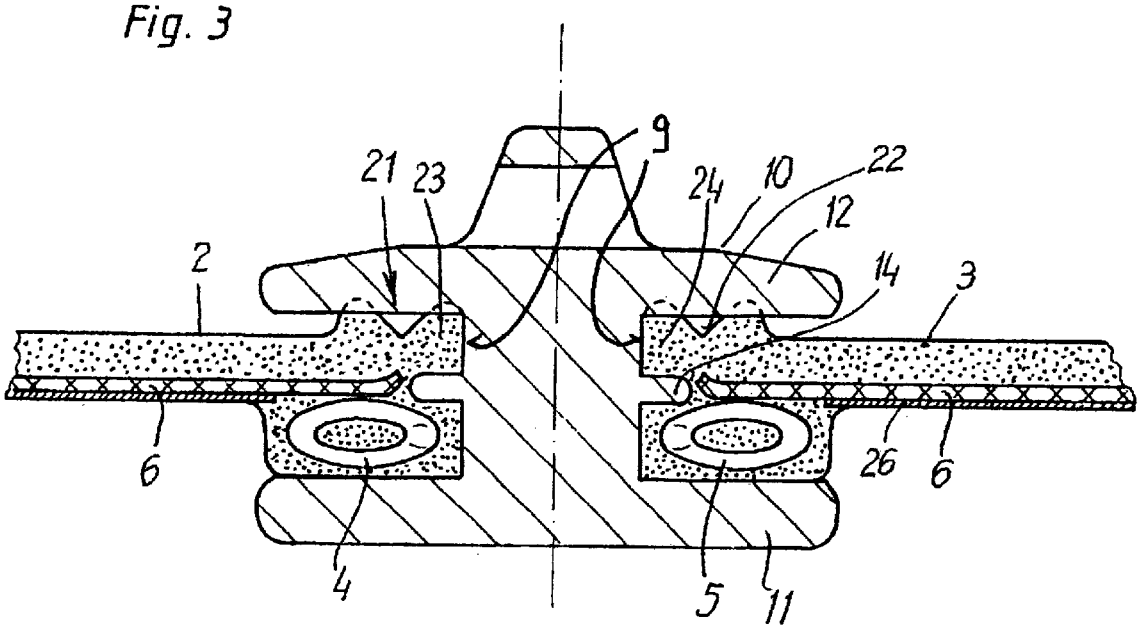

FIG. 3 A diagrammatic sectional view of the zip fastener slider with the two zip fastener carrying tapes along line III—III of FIG. 2.

Figure 4:
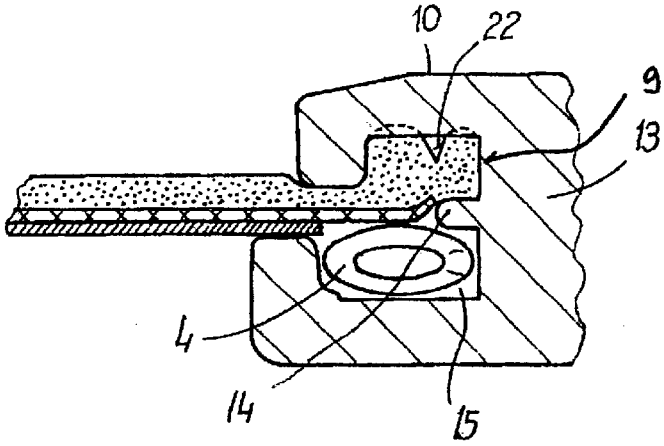

FIG. 4 A diagrammatic sectional view of one half of the zip fastener slider with the zip fastener carrying tape along line IV—IV of FIG. 2.

Figure 5:
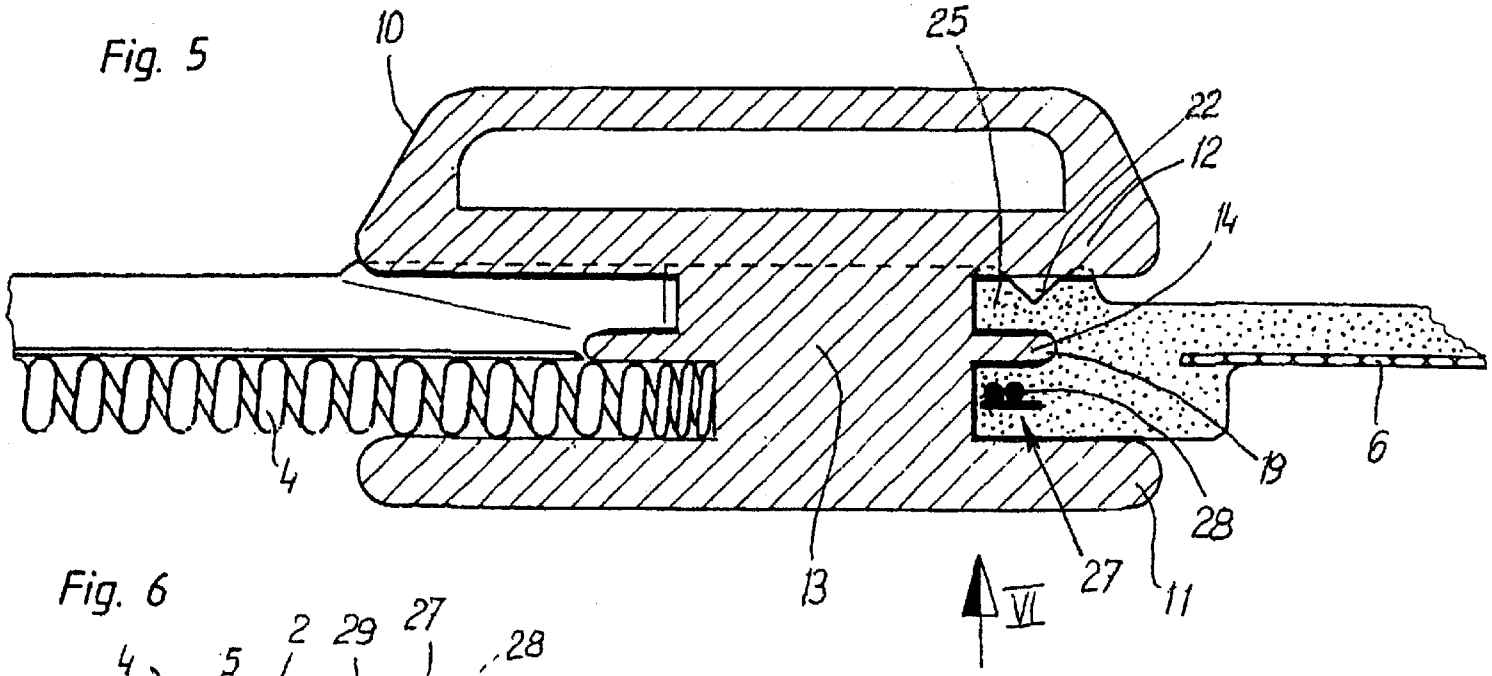

FIG. 5 A diagrammatic longitudinal sectional view of the slider and zip fastener carrying tape along line V—V of FIG. 2.

Figure 6:
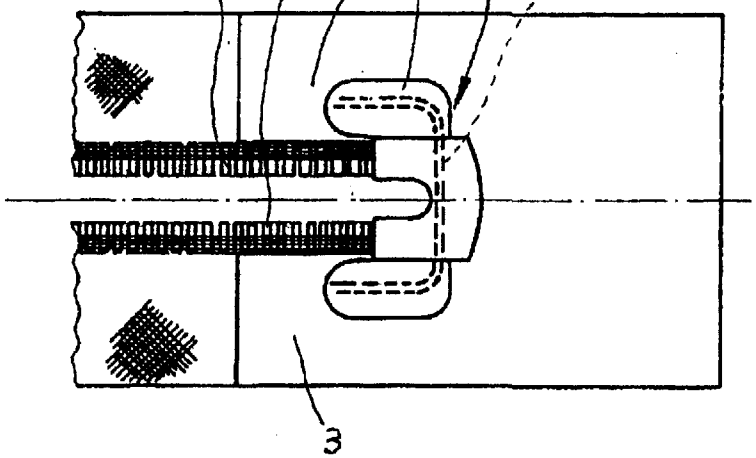

FIG. 6 A diagrammatic view from below of the zip fastener carrying tape in the end region corresponding to the direction of arrow VI in FIG. 5, but without the slider in the opened state.

In conventional manner the zip fastener 1 shown in the drawings has two zip fastener carrying tapes 2, 3 with coupling member rows 4, 5 sewn thereon. The carrying tapes 2, 3 in each case comprise a woven fabric base tape 6, e.g. of polyester or some other plastic material. However, it is also possible to make the base tape 6 from cotton threads.

Each base tape 6 is provided on its side remote from the coupling member rows 4, 5 with a soft, synthetic rubber conveying layer. However, this term covers elastomers, whilst thermoplastics can also be used for coating the base tape 6.

The covering layer is not visible in the drawings. Further details concerning the soft covering layer and its position relative to the end face of the base tape 6, which it completely covers, can be gathered from the applicant's earlier-dated application 199 24 539.8-26. Also invisible and an object of the earlier-dated application is the fact that the continuous coupling member rows 4, 5 are so sewn to the zip fastener carrying tapes 2, 3 that the facing borders of the soft covering layers are in contact with one another along a longitudinal plane, which intersects the zip fastener at a central axis thereof and is at right angles to the principal plane of the zip fastener. If the coupling member rows 4, 5 are disengaged, they project over said longitudinal plane to such an extent that said borders, when the coupling member rows 4, 5 are in engagement, are bent away from the side carrying the coupling member rows and diverge in such a way that they extend roughly at right angles to the principal plane of the zip fastener. The soft covering layers of the facing borders of the two zip fastener carrying tapes 2, 3, which in each case project over the base tape 6, engage on one another under pressure action and consequently fulfill the fluidtightness condition.

The sections of the soft covering layers in the area of the facing borders are thicker than in the remaining areas of the zip fastener carrying tapes. This leads to an increase in the compressive forces acting against one another when the coupling member rows 4, 5 are in the coupled state. The increased mass of the material of the soft covering layers in the spreading and therefore curvature area directly upstream of the end of the base tape 6 ensures an overpressing of the engaging borders of the carrying tapes.

The facing borders of the zip fastener carrying tapes 2, 3 which project over the longitudinal plane in question when the coupling member rows 4, 5 are disengaged, are appropriately preshaped in such a way that they run out in a plane sloping with respect to the zip fastener principal plane and which forms an acute angle with the practical principal plane. As a function of the hardness of the material forming the soft covering layer, said acute angle can be approximately 20 to 40°. The preshaping has an effect on the base tapes 6, as illustrated in FIGS. 1, 3 and 4.

As the drawings only show the conditions in the area of the two interconnected ends of the zip fastener carrying tapes 2, 3, which are provided with an additional elastomer covering in the manner explained hereinafter, the soft covering layers are integrated with the additional covering or coating, i.e. are not visible as independent elements.

The zip fastener slider 10 engaging the zip fastener carrying tapes 2, 3 and transferring same in the case of a longitudinal displacement into the open or closed portion comprises a lower plate 11 and an upper plate 12, as well as a slider wedge 13 interconnecting the two plates. A projecting guide border 14 extending roughly parallel between the upper plate 12 and lower plate 11 is provided in the central area of the slider wedge 13. On either side of the slider wedge 13 this guide border 14 separates the two first chamber 15 and 16 receiving the coupling member rows 4, 5 from the two second chambers 17, 18 receiving the facing borders of the zip fasteners carrying tapes 2, 3. As can in particular be gathered from FIG. 2, the outer edge 19 of the guide border 14 has a substantially constant spacing from the slider wedge 13 carrying the guide border.

FIGS. 3 to 5 show that in the end region of the two zip fastener carrying tapes 2, 3, namely where the coupling member rows 4, 5 run out and no longer fulfill a closing function, a hermetic fluid seal is achieved with the aid of the zip fastener slider 10 and an additional carrying tape elastomer covering. For this purpose the coupling member rows 4, 5 are fully embedded in an elastomer layer roughly corresponding to the thickness of the coupling member rows. To said embedded coupling member rows is connected continuously on the side of the coupling member rows and substantially with the same thickness as the latter a flat layer 20 of elastomer, thermoplastic, etc., which is injection moulded on under a high pressure of approximately 50 bar and which extends on the front side, connecting both lateral sections following the coupling member rows, on either side of the slider wedge 13 into the area between the guide border 14 and lower plate 11 of the slider. On the side of the two interconnected ends of the zip fastener carrying tapes 2, 3 remote from the coupling member rows 4, 5 is also applied an elastomer layer, namely an approximately U-shaped, elastic, flexible cam 21 of elastomer, thermoplastic, etc., which is injection moulded or vulcanized on. When the slider is in the end position it engages on the underside of the upper plate 10 of the slider, accompanied by overpressing, whose strength can be attributed to the oversize, which the cam 21 has compared with the space incorporating the guide border 14 between the top of the lower plate 11 and the bottom of the upper plate 12. A groove 22 bounded by two adjacent protuberance is formed in said U-shaped am 21. This groove 22 extends over the two U-legs 23, 24 of the U-shaped cam 21, as well as the crossbar 25 linking the latter and in each case runs out at the leg end remote from the crossbar, i.e. where the coupling member rows with their carrying tapes and their coupling and closing functions, i.e. immediately adjacent to the slider 10 in the end position. The drawings show in broken line form that in the space between the lower plate 11 and upper plate 12 an overpressing takes place which, despite the closing force reduction, ensures a completely adequate hermetic fluid seal. It is naturally possible to control the extent of the over-pressing by having two juxtaposed grooves in the cam 21 instead of one groove 22.

As will be apparent from FIGS. 3 and 5, in the end position of the slider 10, the guide border 14 is received in a correspondingly U-shaped groove of the elastomer layer, to thereby form a Labyrinth-type seal. The sealing function is improved by providing the groove with a width, which is some what smaller than the width of the guide border 14.

FIGS. 1 and 3 show that the zip fastener carrying tapes are provided in the end region on either side of the coupling member rows and subsequently in the area of the slider end position with a flat reinforcing insert 26, preferably of a polyester woven fabric.

As can be seen in FIG. 5, in the vicinity of the two interconnected ends of the zip fastener carrying tapes 2, 3 is provided a transverse tie bar system 27, which absorbs transverse forces and protects the zip fastener against damage in the case of forcing apart or spreading. It comprises at least one tension-proof, flexible thread 28, which is incorporated into the elastomer, thermoplastic, etc. below the cam crossbar 25 linking the U-legs 23, 24 of the U-shaped cam 21. Said thread is preferably an aramide thread 28.

FIG. 6 diagrammatically shows that on either side of the area of the carrying tapes 2, 3 covered by the slider in the end position are provided strong, flat reinforcing inserts 29 forming part of the transverse tie bar system 27. It is also visible that the tension-proof, flexible thread or threads 28 in each case run out or are woven into the reinforcing inserts 29.

I claim:

1. Fluidtight zip fastener, having a pair of fluidtight zip fastener carrying tapes (2, 3) in each case comprising a base tape (6) with a soft covering layer of elastomer and thermoplastic covering at least one surface thereof and to which is in each case sewn a continuous coupling member row (4, 5) in a position offset in spaced manner transversely to the carrying tape longitudinal edges in such a way that the facing borders (9) of the soft covering layers are in contact with one another along a longitudinal plane intersecting the zip fastener at a central axis thereof and at right angles to the principal plane of the zip fastener, but projecting over said longitudinal plane to such an extent that when the coupling member rows (4, 5) are disengaged and the coupling member rows (4, 5) are engaged they are bent away from that side which carries the coupling member rows and extend roughly at right angles to the principal plane of the zip fastener, the soft covering layers of the facing borders (9) of the two zip fastener carrying tapes (2, 3) projecting over the base tape(6) engage with one another in fluidtight manner under pressure action and in which the zip fastener slider (10) transferring the zip fastener carrying tapes (2, 3) into the open and closed position in the case of longitudinal displacement, apart from a lower plate (11), an upper plate (12) and a slide wedge (13) interconnecting said two plates, has a guide border (14) shaped in the central area of the slider wedge (13) and extending roughly parallel between the upper plate (12) and the lower plate (11) and which on either side of the slider wedge separates two first chambers (15, 16) receiving the coupling member rows (4, 5) from two second chambers (17, 18) receiving the facing borders (9) of the zip fastener carrying tapes, wherein for increasing the sealing action of the zip fastener in the slider end position, the interconnected two ends of the zip fastener carrying tapes are provided with a dimensionally more confined and consequently an overpressing-ensuring elastomer guiding the slider (10) over its guide border (14) shaped onto the slider wedge (13).

2. Zip fastener according to claim 1, wherein on the side of the interconnected ends of the zip fastener carrying tapes (2, 3) remote from the coupling member rows (4, 5) is injection molded or vulcanized an oversize-possessing, approximately U-shaped, elastic, flexible cam (21) engaging on the underside of the upper plate of the slider (10) the U-shaped cam (21).

3. Zip fastener according to claim 2, wherein at least one groove (22) bounded by two adjacent proturbances is formed in the U-shaped cam (21).

4. Zip fastener according to claim 3, wherein the groove (22) extends over two U-legs (23, 24) of the U-shaped cam (21) and a crossbar (25) linking the latter and in each case runs out at a crossbar-remote leg end.

5. Zip fastener according to claim 1, wherein in the area of the interconnected two ends of the zip fastener carrying tapes (2, 3) is provided a transverse force-absorbing transverse tie bar system (27) protecting the zip fastener against damage during spreading.

6. Zip fastener according to claim 5, wherein the transverse tie bar system (27) comprises at least one tension-proof, flexible thread (28) incorporated into the elastomer and thermoplastic below a cam crossbar (25) linking U-legs (23, 24) of a U-shaped cam (21).

7. Zip fastener according to claim 6, wherein the tension-proof thread is formed by an aramide thread (28).

8. Zip fastener according to claim 5, wherein the transverse tie bar system (27) outside and alongside the coupling member rows provided in the end region of the zip fastener carrying tapes has strong, flat reinforcing inserts (29) and that the tension-proof, flexible thread or threads (28) in each case run out over or are woven into the reinforcing inserts (29).

9. Zip fastener according to claim 8, wherein the flat reinforcing inserts (29) are formed by a polyester woven fabric.

10. Zip fastener according to claim 1, wherein, in the slider end position, the guide border (14) is received in a corresponding groove, which is formed within the elastomer.

* * * * *